US010266923B2

(12) United States Patent
Wilks et al.

(10) Patent No.: US 10,266,923 B2
(45) Date of Patent: Apr. 23, 2019

(54) CORRODIBLE DOWNHOLE ARTICLE

(71) Applicant: Magnesium Elektron Limited, Salford (GB)

(72) Inventors: Timothy E. Wilks, Manchester (GB); Mark Turski, Manchester (GB); Matthew Murphy, Manchester (GB)

(73) Assignee: Magnesium Elektron Limited, Manchester (GB)

( * ) Notice: Subject to any disclaimer, the term of this patent is extended or adjusted under 35 U.S.C. 154(b) by 0 days.

(21) Appl. No.: 15/865,776

(22) Filed: Jan. 9, 2018

(65) Prior Publication Data

US 2018/0202028 A1 Jul. 19, 2018

(30) Foreign Application Priority Data

Jan. 16, 2017 (GB) ..... 1700716.2

(51) Int. Cl.

| | |
|---|---|
| ***C22C 23/06*** | (2006.01) |
| ***C22C 1/02*** | (2006.01) |
| ***E21B 33/12*** | (2006.01) |
| ***E21B 34/06*** | (2006.01) |

(52) U.S. Cl.

CPC ..... *C22C 23/06* (2013.01); *C22C 1/02* (2013.01); *E21B 33/12* (2013.01); *E21B 34/06* (2013.01)

(58) Field of Classification Search

CPC ..... C22C 23/06; C22C 1/02

See application file for complete search history.

(56) References Cited

U.S. PATENT DOCUMENTS

| | | | | |
|---|---|---|---|---|
| 6,230,799 B1 * | 5/2001 | Slaughter | ..... | E21B 28/00 166/177.2 |
| 2016/0024619 A1 | 1/2016 | Wilks et al. | | |
| 2018/0010217 A1 | 1/2018 | Wilks et al. | | |

FOREIGN PATENT DOCUMENTS

| | | | | | |
|---|---|---|---|---|---|
| CN | 104152775 A | | 11/2014 | | |
| CN | 106086559 A | | 11/2016 | | |
| EP | 0400574 A1 | * | 12/1990 | ..... | C22C 23/06 |
| GB | 2095288 A | | 9/1982 | | |
| GB | 2529062 A | | 2/2016 | | |
| JP | 09-263871 | * | 10/1997 | ..... | C22C 23/06 |
| JP | 2008-280565 | * | 11/2008 | ..... | C22C 23/06 |
| WO | WO2010038016 A1 | | 4/2010 | | |

OTHER PUBLICATIONS

English Abstract and English Machine Translation of Kubota et al. (JP 09-263871) (Oct. 7, 1997).*

English Abstract and English Machine Translation of Ozaki et al. (JP 2008-280565) (Nov. 20, 2008).*

Combined Search and Examination Report for GB1700716.2 dated Jun. 15, 2017, 8 pages.

U.S. Appl. No. 15/865,768, filed Jan. 9, 2018, entitled Corrodible Downhole Article, Inventor Timothy E. Wilks, et al.

International Search Report and Written Opinion for PCT/GB2018/050039, dated Mar. 29, 2018, 11 pages.

* cited by examiner

*Primary Examiner* — Jessee R Roe

(74) *Attorney, Agent, or Firm* — Abel Law Group, LLP

(57) ABSTRACT

A magnesium alloy is suitable for use as a corrodible downhole article, wherein the alloy includes:

(a) 2-7 wt % Gd,
(b) 0-2 wt % Y,
(c) 0-5.0 wt % Nd, and
(d) at least 80 wt % Mg, and has an elongation as measured by ASTM B557M-10 of at least 22%.

15 Claims, 1 Drawing Sheet

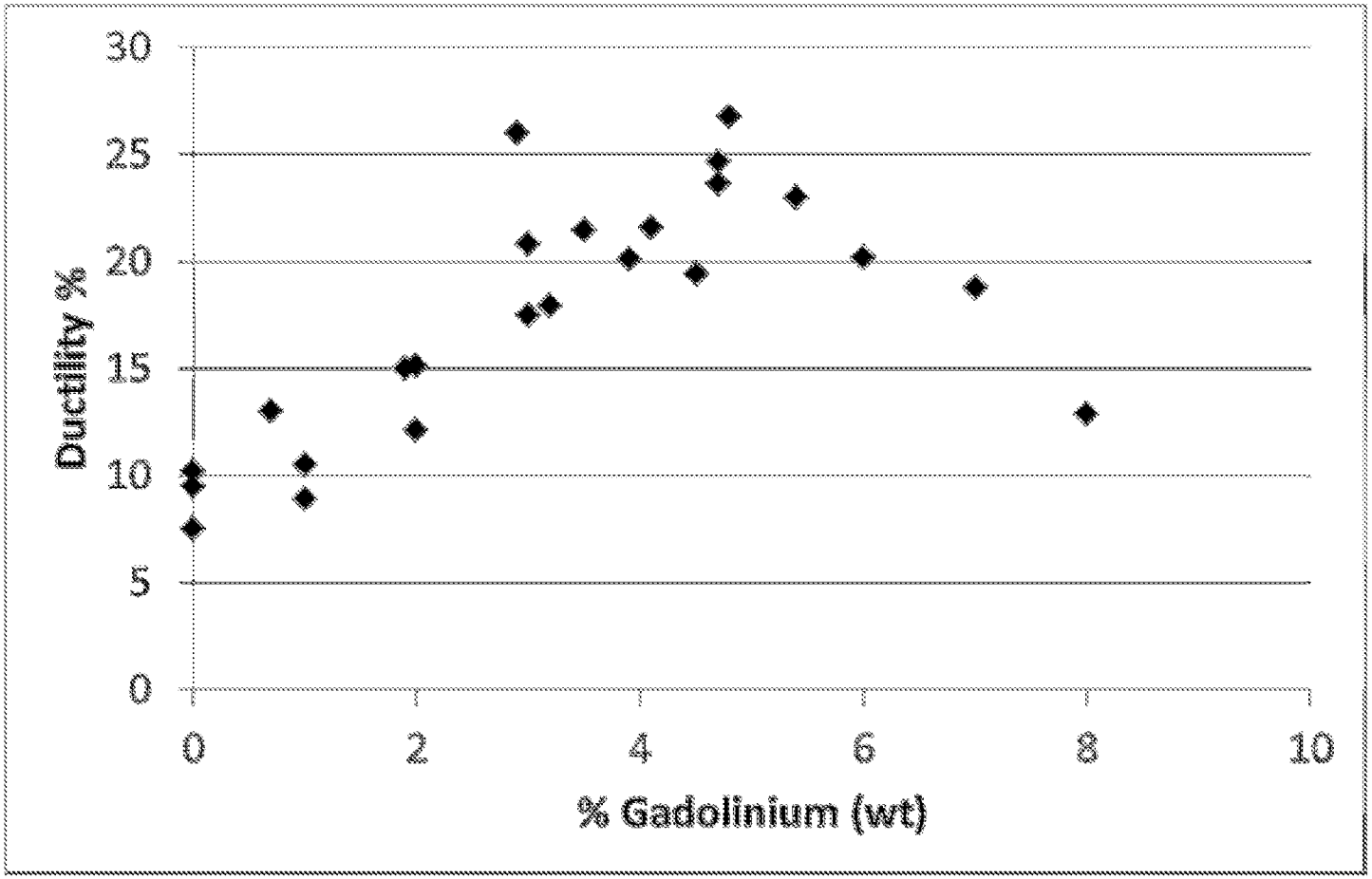
Ductility %
30
25
20
15
10
5
0
0
2
4
6
8
10
% Gadolinium (wt)

CORRODIBLE DOWNHOLE ARTICLE

TECHNICAL FIELD

This disclosure relates to a magnesium alloy suitable for use as a corrodible downhole article, a method for making such an alloy, an article comprising the alloy and the use of the article.

BACKGROUND

The oil and gas industries utilise a technology known as hydraulic fracturing or "fracking". This normally involves the pressurisation with water of a system of boreholes in oil and/or gas bearing rocks in order to fracture the rocks to release the oil and/or gas.

In order to achieve this pressurisation, valves may be used to block off or isolate different sections of a borehole system. These valves are referred to as downhole valves, the word downhole being used in the context of the disclosure to refer to an article that is used in a well or borehole.

Downhole plugs are one type of valve. A conventional plug consists of a number of segments that are forced apart by a conical part. The cone forces the segments out until they engage with the pipe bore. The plug is then sealed by a small ball. Another way of forming such valves involves the use of spheres (commonly known as fracking balls) of multiple diameters that engage on pre-positioned seats in the pipe lining. Downhole plugs and fracking balls may be made from aluminium, magnesium, polymers or composites.

A problem with both types of valve relates to the ductility of the material used to make them. Corrodible magnesium alloys such as those used to make downhole valves have limited ductility due to their hexagonal crystal structure. These alloys can exhibit significant crystallographic texture (ie crystals aligned in a particular direction) when used in their wrought form, such as when they are extruded. This can further limit ductility, especially in the transverse direction. These factors mean that the ductility of dissolvable magnesium alloys is lower than is desirable.

The applicant's earlier patent application, GB2529062A, relates to a magnesium alloy suitable for use as a corrodible downhole article. This document discloses an alloy comprising 3.7-4.3 wt % Y, 0.2-1.0 wt % Zr, 2.0-2.5 wt % Nd and 0.3-1.0 wt % rare earths having a maximum elongation (ie ductility) of 21%, a corrosion rate of around 1100 mg/cm$^2$/day in 3% KCl at 93° C. (200 F) and a 0.2% proof stress of around 200 MPa. The range of uses of these magnesium alloys can be limited by their ductility.

CN 106086559 describes magnesium alloys comprising Gd and/or Y as well as Ni. However, the atomic percentage amounts of Y and/or Gd in these alloys correspond to weight percentages which are greater than 2 wt % Y and/or greater than 7 wt % Gd. CN 104152775 relates to a magnesium alloy comprising 86.7 wt % Mg, 2.2 wt % Ni, 5.8 wt % Gd and 5.3% Nd.

A material which provides the desired corrosion characteristics, but with improved ductility, has been sought.

SUMMARY OF THE DISCLOSURE

This disclosure relates to a magnesium alloy suitable for use as a corrodible downhole article, wherein the alloy comprises:

(a) 2-7 wt % Gd,
(b) 0-2 wt % Y,
(c) 0-5.0 wt % Nd, and
(d) at least 80 wt % Mg, and has an elongation as measured by ASTM B557M-10 of at least 22%.

In relation to this disclosure, the term "alloy" is used to mean a composition made by mixing and fusing two or more metallic elements by melting them together, mixing and re-solidifying them.

The term "rare earth metals" is used in relation to the disclosure to refer to the fifteen lanthanide elements, as well as Sc and Y.

It should be appreciated that in the magnesium alloys of this disclosure, the recited weight percentages of elements are based on a total weight of the composition and when combined equal 100%. Further, use of "comprising" transitional claim language does not exclude additional, unrecited elements or method steps. Moreover, the disclosure also contemplates use of "consisting essentially of" transitional claim language, which limits the scope of the claim to the specified materials or steps and those that do not materially affect the basic and novel characteristic(s) of the claimed invention which include a function of the magnesium alloy as a corrodible downhole article, in particular, including an elongation as measured by ASTM B557M-10 of at least 22%. When numerical ranges are used, the range includes the endpoints unless otherwise indicated.

Many features, advantages and a fuller understanding of the disclosure will be had from the accompanying drawings and the Detailed Description that follows. The following FIGURE is not intended to limit the subject matter of this disclosure as claimed. It should be understood that the following Detailed Description describes the subject matter of the disclosure and presents specific embodiments that should not be construed as necessary limitations of the disclosed subject matter as set forth in the claims.

BRIEF DESCRIPTION OF THE DRAWINGS

FIG. 1 shows a graph of ductility against Gd content in wt %.

DETAILED DESCRIPTION

This disclosure relates to a magnesium alloy suitable for use as a corrodible downhole article, wherein the alloy comprises:

(a) 2-7 wt % Gd,
(b) 0-2 wt % Y,
(c) 0-5.0 wt % Nd, and
(d) at least 80 wt % Mg, and has an elongation as measured by ASTM B557M-10 of at least 22%.

Plugs and fracking balls made from the magnesium alloys of the disclosure can find a broader range of uses.

In particular, the alloy may have an elongation as measured by ASTM B557M-10 of at least 23%, more particularly at least 24%, even more particularly at least 25%.

In particular, the magnesium alloy may comprise rare earth metals other than Gd in a total amount of less than 5 wt %, more particularly in a total amount of less than 3 wt %, even more particularly in a total amount of less than 1 wt %. In some embodiments, the magnesium alloy may comprise rare earth metals other than Gd in a total amount of less than 0.5 wt %, more particularly less than 0.1 wt %. In particular embodiments, the magnesium alloy may be substantially free of rare earth metals other than Gd. More particularly, the rare earth metals other than Gd may comprise Y and/or Nd, even more particularly they may be Y and/or Nd.

More particularly, the magnesium alloy may comprise Gd in an amount of 3-6 wt %, even more particularly in an amount of 4.0-6.0 wt %. In some embodiments, the magnesium alloy may comprise Gd in an amount of 4.5-5.5 wt %, more particularly 4.6-4.9 wt %.

More particularly, the magnesium alloy may comprise Zr in an amount of up to 1.0 wt %. In some embodiments, the magnesium alloy may comprise Zr in an amount of 0.01-0.5 wt %, more particularly in an amount of 0.02-0.2 wt %, even more particularly in an amount of 0.05-0.10 wt %. In some embodiments, the magnesium alloy may be substantially free of Zr.

In particular, the magnesium alloy may comprise one or more elements which promote corrosion. More particularly, the one or more elements may be one or more transition metals. In particular, the magnesium alloy may comprise one or more of Ni, Co, Ir, Au, Pd, Fe or Cu. These elements are known in the art to promote the corrosion of magnesium alloys. The magnesium alloy may comprise 0-2 wt % in total of one or more of Ni, Co, Ir, Au, Pd, Fe or Cu, more particularly 0.1-2 wt %, even more particularly 0.2-1.0 wt %. In some embodiments, the magnesium alloy may comprise 0.4-0.8 wt % in total of one or more of Ni, Co, Ir, Au, Pd, Fe or Cu, more particularly 0.5-0.7 wt %.

In particular, the magnesium alloy may comprise 0-2 wt % Ni, more particularly 0.1-2 wt %, even more particularly 0.2-1.0 wt %. In some embodiments, the magnesium alloy may comprise Ni in an amount of 0.4-0.8 wt %, more particularly 0.5-0.7 wt %.

More particularly, the magnesium alloy may comprise Y in an amount of less than 1 wt %, even more particularly less than 0.5 wt %, more particularly less than 0.1 wt %. In some embodiments, the magnesium alloy may be substantially free of Y.

In particular, the magnesium alloy may comprise Nd in an amount of less than 2 wt %. More particularly, the magnesium alloy may comprise Nd in an amount of less than 1 wt %, even more particularly less than 0.5 wt %, more particularly less than 0.1 wt %. In some embodiments, the magnesium alloy may be substantially free of Nd.

More particularly, the magnesium alloy may comprise Al in an amount of less than 1 wt %, even more particularly less than 0.5 wt %, more particularly less than 0.1 wt %. In some embodiments, the magnesium alloy may be substantially free of Al.

In particular, the magnesium alloy may comprise Ce (for example, in the form of mischmetal) in an amount of less than 1 wt %, even more particularly less than 0.5 wt %, more particularly less than 0.1 wt %. In some embodiments, the magnesium alloy may be substantially free of Ce.

More particularly, the remainder of the alloy may be magnesium and incidental impurities. In particular, the content of Mg in the magnesium alloy may be at least 85 wt %, more particularly at least 90 wt %, even more particularly at least 92 wt %.

A particularly preferred composition of the first embodiment is a magnesium alloy comprising rare earth metals other than Gd in a total amount of less than 2 wt %, Gd in an amount of 4.0-6.0 wt %, Zr in an amount of 0.02-0.2 wt %, Ni in an amount of 0.1-0.8 wt % and Mg in an amount of at least 90 wt %.

In particular, the magnesium alloy may have a corrosion rate of at least 50 mg/cm$^2$/day, more particularly at least 75 mg/cm$^2$/day, even more particularly at least 100 mg/cm$^2$/day, in 3% KCl at 38° C. (100 F). In particular, the magnesium alloy may have a corrosion rate of at least 50 mg/cm$^2$/day, more particularly at least 250 mg/cm$^2$/day, even more particularly at least 500 mg/cm$^2$/day, in 15% KCl at 93° C. (200 F). More particularly, the corrosion rate, in 3% KCl at 38° C. or in 15% KCl at 93° C. (200 F), may be less than 15,000 mg/cm$^2$/day.

In particular, the magnesium alloy may have a 0.2% proof stress of at least 75 MPa, more particularly at least 100 MPa, even more particularly at least 125 MPa, when tested using standard tensile test method ASTM B557-10. More particularly, the 0.2% proof stress may be less than 700 MPa. The 0.2% proof stress of a material is the stress at which material strain changes from elastic deformation to plastic deformation, causing the material to deform permanently by 0.2% strain.

In addition, this disclosure relates to a wrought magnesium alloy having the composition described above.

This disclosure also relates to a corrodible downhole article, such as a downhole tool, comprising the magnesium alloy described above. In some embodiments, the corrodible downhole article is a fracking ball, plug, packer or tool assembly. In particular, the fracking ball may be substantially spherical in shape. In some embodiments, the fracking ball consists essentially of the magnesium alloy described above.

This disclosure also relates to a method for producing a magnesium alloy suitable for use as a corrodible downhole article comprising the steps of:

(a) heating Mg, Gd, and optionally one or more of Y and Nd, to form a molten magnesium alloy comprising 2-7 wt % Gd, 0-2 wt % Y, 0-5.0 wt % Nd, and at least 80 wt % Mg, (b) mixing the resulting molten magnesium alloy, and (c) casting the magnesium alloy.

In particular, the method may be for producing a magnesium alloy as defined above. Any other required components in the resulting alloy (for example, those listed in the preceding paragraphs describing the alloy) can be added in heating step (a). More particularly, the heating step may be carried out at a temperature of 650° C. (ie the melting point of pure magnesium) or more, even more particularly less than 1090° C. (the boiling point of pure magnesium). In particular, the temperature range may be 650° C. to 850° C., more particularly 700° C. to 800° C., even more particularly about 750° C. More particularly, in step (b) the resulting alloy may be fully molten.

The casting step normally involves pouring the molten magnesium alloy into a mould, and then allowing it to cool and solidify. The mould may be a die mould, a permanent mould, a sand mould, an investment mould, a direct chill casting (DC) mould, or other mould.

After step (c), the method may comprise one or more of the following additional steps: (d) extruding, (e) forging, (f) rolling, (g) machining.

The composition of the magnesium alloy can be tailored to achieve a desired corrosion rate falling in a particular range. The desired corrosion rate in 15% KCl at 93° C. can be in any of the following particular ranges: 50-100 mg/cm$^2$/day; 100-250 mg/cm$^2$/day; 250-500 mg/cm$^2$/day; 500-1000 mg/cm$^2$/day; 1000-3000 mg/cm$^2$/day; 3000-4000 mg/cm$^2$/day; 4000-5000 mg/cm$^2$/day; 5000-10,000 mg/cm$^2$/day; 10,000-15,000 mg/cm$^2$/day.

The method of the disclosure may also comprise tailoring compositions of the magnesium alloys such that the cast magnesium alloys achieve desired corrosion rates in 15% KCl at 93° C. falling in at least two of the following ranges:

50 to 100 mg/cm$^2$/day; 100-250 mg/cm$^2$/day; 250-500 mg/cm$^2$/day; 500-1000 mg/cm$^2$/day; 1000-3000 mg/cm$^2$/day; 3000-4000 mg/cm$^2$/day; 4000-5000 mg/cm$^2$/day; 5000-10,000 mg/cm$^2$/day; and 10,000-15,000 mg/cm$^2$/day.

This disclosure also relates to a magnesium alloy suitable for use as a corrodible downhole article which is obtainable by the method described above.

In addition, this disclosure relates to a magnesium alloy as described above for use as a corrodible downhole article.

This disclosure also relates to a method of hydraulic fracturing comprising the use of a corrodible downhole article comprising the magnesium alloy as described above, or a downhole tool as described above. In particular, the method may comprise forming an at least partial seal in a borehole with the corrodible downhole article. The method may then comprise removing the at least partial seal by permitting the corrodible downhole article to corrode. This corrosion can occur at a desired rate with certain alloy compositions of the disclosure as discussed above. More particularly, the corrodible downhole article my be a fracking ball, plug, packer or tool assembly. In particular, the fracking ball may be substantially spherical in shape. In some embodiments, the fracking ball may consist essentially of the magnesium alloy described above.

The disclosure will now be described by reference to the following Examples which are presented to better explain particular aspects of the disclosure and should not be used to limit the subject matter of this disclosure as claimed.

EXAMPLES

Magnesium alloy compositions were prepared by combining the components in the amounts listed in Table 1 below. These compositions were then melted by heating at 750° C. The melt was then cast into a billet and extruded to a rod.

TABLE 1

| | Chemistry (wt %) | | | | | | Properties | | |
|---|---|---|---|---|---|---|---|---|---|
| | | | | | | | 0.2% Proof | Ultimate Tensile | |
| Example number | RE* | RE Type | Ni | Gd | Al | Zr | Stress (MPa) | Strength (MPa) | Elongation (%) |
| 1† | 1.4 | Y | 0.6 | 0 | — | 0.02 | 152 | 248 | 10.2 |
| 2† | 1.6 | Nd | 0.6 | 0 | — | 0 | 101 | 195 | 7.5 |
| 3† | 3.3 | Nd | 0.6 | 0 | — | 0 | 141 | 216 | 9.5 |
| 4† | 1.4 | Y | 0.7 | 0.7 | — | 0.01 | 169 | 256 | 13 |
| 5† | 3.3 | Nd | 0.6 | 1 | — | 0 | 187 | 251 | 8.9 |
| 6† | 3.3 | Nd | 0.6 | 1 | 0.4 | 0 | 192 | 247 | 10.5 |
| 7† | — | | 0.7 | 1.9 | — | 0.02 | 150 | 239 | 15.0 |
| 8† | — | | 0.2 | 2.0 | — | 0.03 | 136 | 204 | 12.1 |
| 9† | — | | 0.4 | 2.0 | — | 0.03 | 159 | 234 | 15.1 |
| 10 | — | | 0.4 | 2.9 | — | 0.02 | 150 | 227 | 26.0 |
| 11† | — | | 0.6 | 3.0 | — | 0.02 | 156 | 238 | 17.5 |
| 12† | — | | 0.4 | 3.0 | 0.2 | 0.02 | 142 | 227 | 20.8 |
| 13† | 1.3 | Y | 0.58 | 3.2 | — | 0.01 | 152 | 236 | 17.9 |
| 14 | — | | 0.6 | 3.5 | — | 0.03 | 156 | 236 | 21.5 |
| 15† | 1.4 | Y | 0.58 | 3.9 | — | 0.02 | 156 | 240 | 20.1 |
| 16 | — | | 0.6 | 4.1 | — | 0.03 | 153 | 227 | 21.6 |
| 17† | 1.3 | Y | 0.57 | 4.5 | — | 0.04 | 157 | 243 | 19.4 |
| 18 | — | | 0.6 | 4.7 | — | 0.03 | 158 | 233 | 23.6 |
| 19 | — | | 0.2 | 4.7 | — | 0.02 | 139 | 217 | 24.6 |
| 20 | — | | 0.6 | 4.8 | — | 0.02 | 146 | 228 | 26.8 |
| 21 | — | | 0.6 | 5.4 | — | 0.01 | 152 | 236 | 23.0 |
| 22† | — | | 0.6 | 6.0 | — | 0.02 | 147 | 232 | 20.2 |
| 23† | — | | 0.6 | 7 | — | 0.02 | 152 | 239 | 18.8 |
| 24† | — | | 0.6 | 8 | — | 0.02 | 158 | 241 | 12.8 |

*RE includes all Rare Earth elements, including yttrium, but excluding gadolinium †Comparative examples This data clearly shows that the examples of the disclosure surprisingly show a significantly improved elongation/ductility. This is confirmed by viewing this data in the form of the graph of FIG. 1.

Many modifications and variations of the disclosed subject matter will be apparent to those of ordinary skill in the art in light of the foregoing disclosure. Therefore, it is to be understood that, within the scope of the appended claims, the disclosed subject matter can be practiced otherwise than has been specifically shown and described.

The invention claimed is:

1. A magnesium alloy suitable for use as a corrodible downhole article, wherein the alloy comprises:

(a) 2-7 wt % Gd, (b) less than 1 wt % Y, (c) less than 1 wt % Nd, (d) one or more of Ni, Co, Ir, Au, Pd or Fe in an amount of 0.1-1.0 wt % in total, and (e) at least 80 wt % Mg, and has an elongation as measured by ASTM B557M-10 of at least 22%.

2. A magnesium alloy as claimed in claim 1 having an elongation as measured by ASTM B557M-10 of at least 24%.

3. A magnesium alloy as claimed in claim 1 comprising Gd in an amount of 4.0-6.0 wt %.

4. A magnesium alloy as claimed in claim 3 comprising Gd in an amount of 4.5-5.5 wt %.

5. A magnesium alloy as claimed in claim 1 comprising one or more of Ni, Co, Ir, Au, Pd or Fe in an amount of 0.1-0.8 wt % in total.

6. A magnesium alloy as claimed in claim 1 comprising rare earth metals other than Gd in a total amount of less than 1 wt %.

7. A magnesium alloy as claimed in claim 1 comprising Zr in an amount of 0.01-0.5 wt %.

8. A magnesium alloy as claimed in claim 7 comprising Zr in an amount of 0.02-0.2 wt %.

9. A magnesium alloy as claimed in claim 1 wherein the content of Mg in the magnesium alloy is at least 85 wt %.

10. A magnesium alloy as claimed in claim 9 wherein the content of Mg in the magnesium alloy is at least 90 wt %.

11. A magnesium alloy as claimed in claim 1 having a corrosion rate of at least 50 $mg/cm^2/day$ in 15% KCl at 93° C.

12. A downhole tool comprising a magnesium alloy as claimed in claim 1.

13. A method for producing a magnesium alloy as claimed in claim 1, comprising the steps of:

(a) heating Mg, Gd, optionally one or more of Y and Nd, and one or more of Ni, Co, Ir, Au, Pd or Fe, to form a molten magnesium alloy comprising 2-7 wt % Gd, less than 1 wt % Y, less than 1 wt % Nd, one or more of Ni, Co, Ir, Au, Pd or Fe in an amount of 0.1-1.0 wt % in total, and at least 80 wt % Mg, (b) mixing the resulting molten magnesium alloy, and (c) casting the magnesium alloy.

14. A method for producing a magnesium alloy as claimed in claim 13 wherein the molten magnesium alloy comprises said one or more of Ni, Co, Ir, Au, Pd or Fe in an amount of 0.1-0.8 wt % in total.

15. A magnesium alloy suitable for use as a corrodible downhole article, wherein the alloy comprises:

2-7 wt % Gd, rare earth metals other than Gd in an amount of less than 5 wt %, including less than 1 wt % Nd and less than 1 wt % Y, 0.1-2 wt % Ni, and at least 85 wt % Mg, and has an elongation as measured by ASTM B557M-10 of at least 22%.

* * * * *